US007348481B2

(12) United States Patent
Miwa

(10) Patent No.: US 7,348,481 B2
(45) Date of Patent: Mar. 25, 2008

(54) CURSOR MOVEMENT CONTROLLING APPARATUS FOR ELECTRONIC MUSICAL APPARATUS

(75) Inventor: Akihiro Miwa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 145 days.

(21) Appl. No.: 10/712,687

(22) Filed: Nov. 12, 2003

(65) Prior Publication Data

US 2004/0094022 A1 May 20, 2004

(30) Foreign Application Priority Data

Nov. 15, 2002 (JP) ..... 2002-332547

(51) Int. Cl.
*G10H 1/00* (2006.01)

(52) U.S. Cl. ..... 84/600; 715/856

(58) Field of Classification Search ..... 84/600, 84/615, 645, 470, 477 R; 345/157; 715/856
See application file for complete search history.

(56) References Cited

U.S. PATENT DOCUMENTS 5,225,617 A * 7/1993 Hotta ..... 84/477 R
5,237,417 A * 8/1993 Hayashi et al. ..... 348/569
5,434,626 A * 7/1995 Hayashi et al. ..... 348/569
5,598,183 A * 1/1997 Robertson et al. ..... 715/856
5,646,362 A * 7/1997 Koyama et al. ..... 84/615
5,739,454 A * 4/1998 Kunimoto ..... 84/615
2003/0067442 A1* 4/2003 Bates et al. ..... 345/157

FOREIGN PATENT DOCUMENTS

JP 01175021 A * 7/1989
JP 02-041516 2/1990
JP 6-301478 10/1994
JP 10-232678 9/1998

* cited by examiner

*Primary Examiner*—Lincoln Donovan
*Assistant Examiner*—Jianchun Qin
(74) *Attorney, Agent, or Firm*—Morrison & Foerster LLP

(57) ABSTRACT

A cursor movement controlling apparatus for an electronic musical apparatus comprises a display that displays a plurality of choices for controlling parameters of the electronic music apparatus, each of which is categorized into one of groups, and a cursor for selecting the choices, an instructor that instruct a movement of the displayed cursor, a movement storage device that stores a content of the movement of the cursor when the movement of the cursor within the group is instructed, and a cursor moving device that moves, when the movement of the cursor to other group is instructed, the cursor to the choice that is in the other group and corresponding to the content of the movement storage device.

6 Claims, 5 Drawing Sheets

CURSOR MOVEMENT CONTROLLING APPARATUS FOR ELECTRONIC MUSICAL APPARATUS

This application is based on Japanese Patent Application 2002-332547, filed on Nov. 15, 2002, the entire contents of which are incorporated herein by reference.

BACKGROUND OF THE INVENTION

A) Field of the Invention

This invention relates to a cursor movement controlling apparatus for an electronic musical apparatus, and more particularly to a cursor movement controlling apparatus controlling a movement of a cursor for setting a musical parameter of an electronic musical apparatus.

B) Description of the Related Art

An electronic musical apparatus such as a mixer, a musical keyboard, a synthesizer, a musical tone generator, etc. wherein setting is performed by modifying a plurality of parameters displays choices for modifying various settings in a plurality of columns on a screen of a display, etc.

In each column, one or plurality of choices is/are prepared, and by selecting either one of the choices by moving a cursor displayed on the screen with an operator such as arrow switches, etc., a user can modify a parameter corresponding to the selected choice.

Generally, in an electronic music apparatus, a movement of the cursor is controlled by cursor movement switches of up, down, right and left, and comparing to an operator of a personal computer such as a mouse, etc., it is difficult to directly select a desired parameter by using the cursor movement switches.

Therefore, in the above-described electronic musical apparatus, in order to select a parameter with an efficient movement of the cursor, for example, a plurality of parameters are categorized into groups, and a movement of the cursor is controlled in accordance with an operation type of the operator to be moved by the group or within the group (for example, refer to Japanese Patent Application Laid-open No. Hei 06-301478).

When the cursor is moved to the other group of the parameters by the arrow switches (cursor movement switches), the cursor is always moved to a choice listed in a top of the group. The operation of the cursor may be irritating because even if a user desires to select a previously selected choice, the user should move the cursor within the group after moving the cursor to that group.

SUMMARY OF THE INVENTION

It is an object of the present invention to provide a cursor movement controlling apparatus that enables an efficient movement of a cursor.

According to one aspect of the present invention, there is provided a cursor movement controlling apparatus for an electronic musical apparatus comprising a display that displays a plurality of choices for controlling parameters of the electronic music apparatus, each of which is categorized into one of groups, and a cursor for selecting the choices, an instructor that instruct a movement of the displayed cursor, a movement storage device that stores a content of the movement of the cursor when the movement of the cursor within the group is instructed, and a cursor moving device that moves, when the movement of the cursor to other group is instructed, the cursor to the choice that is in the other group and corresponding to the content of the movement storage device.

According to the present invention, a cursor movement controlling apparatus that enables an efficient movement of a cursor can be provided.

DETAILED DESCRIPTION OF THE PREFERRED EMBODIMENTS

Figure 1:
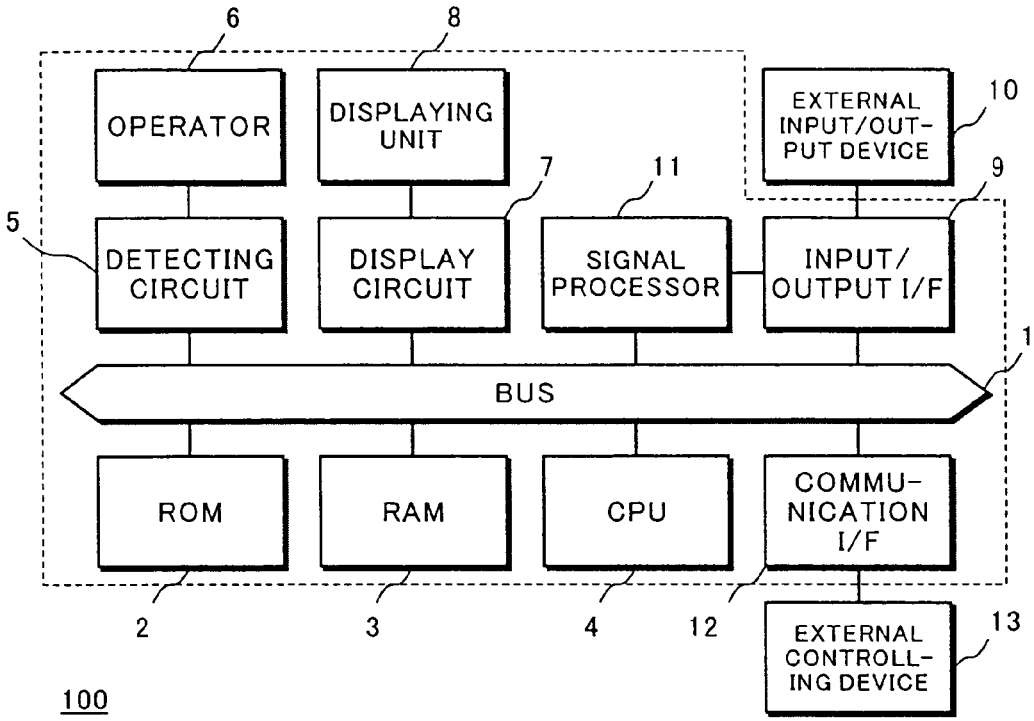
FIG. 1 is a block diagram showing a basic structure of a cursor movement controlling apparatus 100 according to an embodiment of the present invention.

FIG. 1 is a block diagram showing a basic structure of a cursor movement controlling apparatus 100 according to an embodiment of the present invention.

The cursor movement controlling apparatus 100 is, for example, an electronic musical apparatus such as a digital mixer or an analogue mixer that can output an audio signal by mixing audio signals input from a plurality of input lines, a synthesizer, a musical keyboard, a musical tone generator, etc.

To a bus 1 of the cursor movement controlling apparatus 100, a ROM 2, a RAM 3, a CPU 4, a detecting circuit 5, a display circuit 7, a signal processor 11, an input/output interface (I/F) 9 and a communication interface (I/F) are connected.

The ROM 2 can store preset data, various parameters, control programs, a program for realizing this embodiment of the present invention, etc.

The RAM 3 has a working area for the CPU 4, where a flag, a register, various data, etc. are stored. In addition, the RAM 3 has an area for the later-described cursor buffer.

The CPU 4 executes a calculation and various controls in accordance with the control programs, etc. stored in the ROM 2.

The operators 6 are connected to the detecting circuit 5 and input instructions of a user relating to functions of the cursor movement controlling apparatus 100 according to the embodiment of the present invention. The operators 6 are, for example, cursor switches of up, down, right and left, other switches, a jog-shuttle, a rotary encoder, a fader, a slider, etc. The operators 6 may be any types of switches that can input a signal in accordance with an operation of the user.

The user can set parameters for equalizing, effectors, volume control, mixing processes by using the operators 6 consisted of a plurality of operators (input devices). To set the parameters, in this embodiment, the user moves the cursor to a parameter to be set by using the cursor switches of up, down, right and left. The detecting circuit 5 detects operations of the operators 6 such as the cursor switches by the user and transmits control signals corresponding to the detected operations to the display circuit 7, the signal processor 11, etc. The display circuit 7, the signal processor 11, etc. execute controls corresponding to the control signals.

Figure 2:
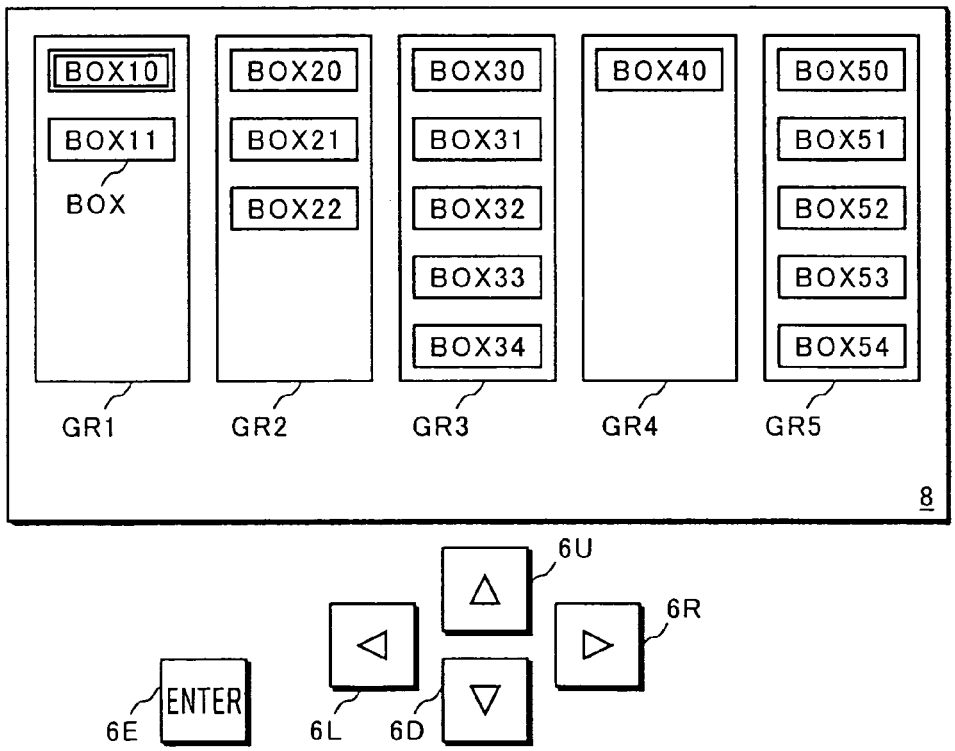
FIG. 2 is a schematic view showing cursor switches and a display configured on a front panel of the cursor movement controlling apparatus 100 according to the embodiment of the present invention.

The display circuit 7 is connected to a displaying unit (a display) 8 and can display channel assignments, various information such as settings of equalizing, effecter, volume, etc. for each channel. The displaying unit 8 is consisted of a liquid crystal display (LCD), a light emitting diode (LED) or something like that; however, the displaying unit 8 may be consisted of any devices that can display the various information. In this embodiment, a parameter selecting screen later explained with reference to FIG. 2 is displayed on the displaying unit 8.

The input/output I/F 9 is equipped with a plurality of analogue or digital audio signal input terminals and outputs an analogue or digital audio signal input from an external input/output device 10, etc. to the signal processor 11. Further, the input/output I/F 9 is equipped with a digital/analogue converter and an analogue/digital converter. In addition, the input/output I/F 9 outputs an analogue or digital audio signal transmitted from the signal processor 11 to the external input/output device 10.

The signal processor 11 is formed with an effecter circuit for assign an effect to the digital audio signal, a digital mixing circuit for mixing a plurality of the digital audio signals, etc. Further, for example, the signal processor 11 may be formed with a plurality of voltage controlled amplifiers (VCA) and voltage controlled filters (VCF), etc. to enable a process of the analogue audio signals.

The communication I/F 12 is an interface that can connect the cursor movement controlling apparatus 100 according to the embodiment with an external controlling device 13 that can remote control the cursor movement controlling apparatus 100, an electronic musical instrument, other audio device, a computer, external hard disk drive (HDD), etc. In this case, the communication I/F 12 is consisted of a general interface such as a MIDI interface, a small computer system interface (SCSI), RS-232C, a universal serial bus (USB) interface, and/or IEEE1394 interface and/or a dedicated interface for the external controlling device. In addition, as the communication I/F 12, the cursor movement controlling apparatus 100 may further equip a communication interface that can connect with a public communication network such as the Internet or a local area network (LAN).

The external controlling device 13 is, for example a computer, other mixing device or a sequencer that executes a program for controlling the cursor movement controlling apparatus 100.

Although not shown in the drawing, the cursor movement controlling apparatus 100 may have an external storage device. For example, a CD-RW drive, a semiconductor memory such as a flash memory, floppy (trademark) disk drive (FDD), a hard disk drive (HDD), a magneto optical (MO) disk drive, a compact disc read only memory (CD-ROM) drive, a digital versatile disc (DVD) drive, etc. may be connected to the cursor movement controlling apparatus 100 as the external storage device.

FIG. 2 is a schematic view showing cursor switches and a display configured on a front panel of the cursor movement controlling apparatus 100 according to the embodiment of the present invention.

On the front panel of the cursor movement controlling apparatus 100, at least the display 8, the cursor switches 6U, 6D, 6L and 6R and a decision switch 6E are configured.

On a screen of the display 8, a plurality of choices BOX for setting parameters are displayed as a parameter selecting screen. The parameters are classified into groups (GR1 to GR5) according to a category of each parameter.

A number of choices BOX in each of the groups (GR1 to GR5) is not fixed, and each group contains one to plurality of choices BOX. The choices BOX included in one group are for controlling or setting parameters of at least one function, and a parameter assigned to one choice BOX is different from a parameter assigned to other choice BOX.

Each choice BOX corresponds to a number (a cursor buffer value) "0 to n (n is a maximum number of the choices BOX in one group)" stored in the cursor buffer in the RAM 3. For example, the choice BOX10 corresponds to the number "0", and the choice BOX54 corresponds to the number "4".

A current cursor position is at the choice BOX displayed in a different style from the other choices BOX on the screen of the display 8. In this example, the current cursor position is at the choice BOX10 surrounded by a double frame. To indicate the current cursor position, any styles that the user can distinguish the current cursor position from other choices BOX may be used, for example, a color of the choice at the current cursor position may be inverted, or the choice BOX may displayed in a different color or luminescence from other choices BOX.

The user can move the cursor (change the cursor position) by operating the cursor switches 6U, 6D, 6L and 6R. The cursor switches 6U (instructing an upward movement), 6D (instructing a downward movement), 6L (instructing a leftward movement) and 6R (instructing a rightward movement) instruct the movement of the cursor to the choices BOX placed in directions of upward, downward, leftward and rightward respectively. When the user operates the decision switch 6E, a parameter corresponding to the choice BOX at the current cursor position is set or controlled. For example, switching of ON/OFF of a function corresponding to the choice BOX at the current cursor position, selection of the various data, execution of various processes, entering of various modes, moving to other displayed pages, etc. are executed.

Further, in reality, a multiplicity of the operators 6 are configured on the front panel, and other parameters that can be set and current status are displayed on the screen of the display 8 although they are not shown in the drawing.

Figure 3:
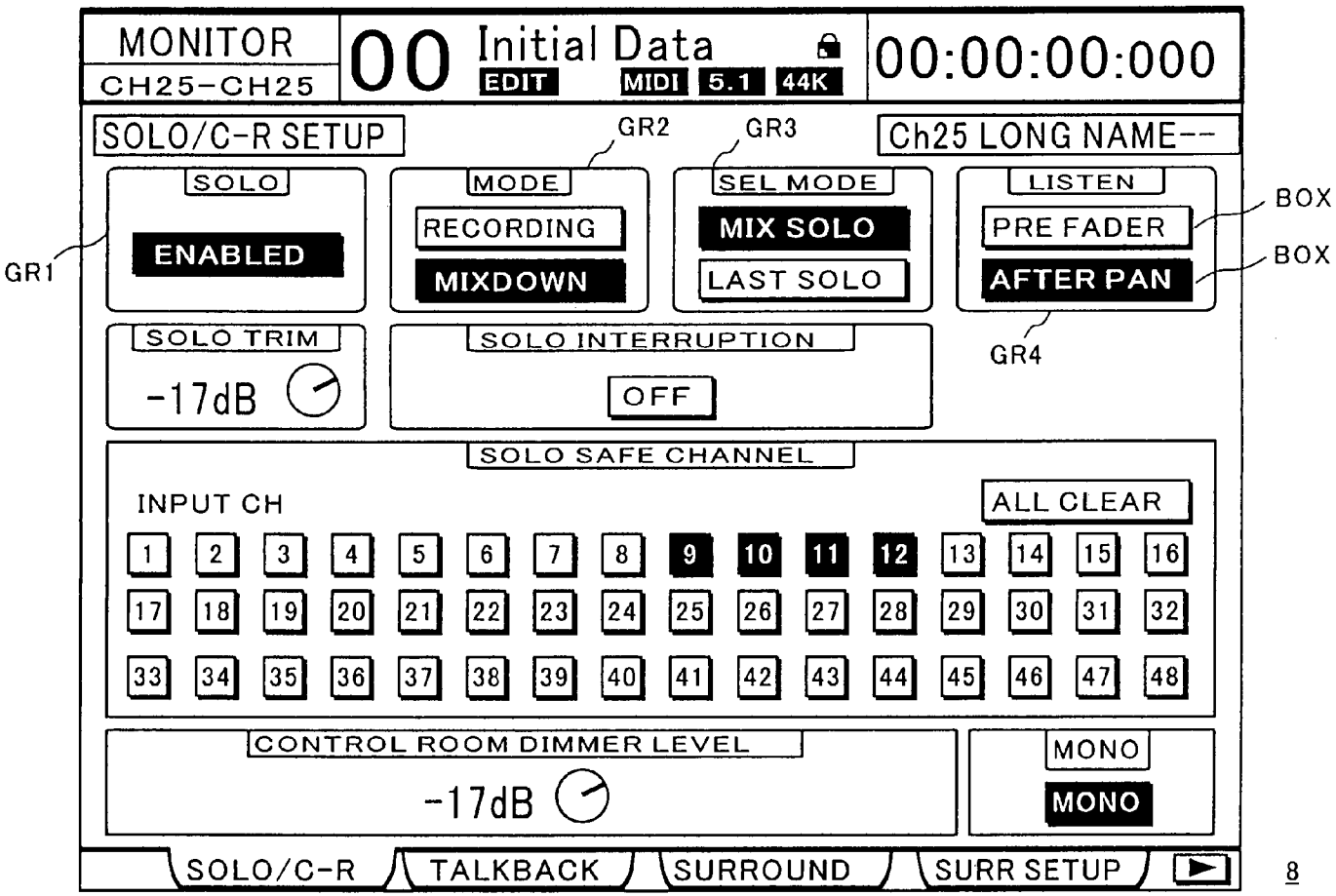
FIG. 3 shows an example of a screen displayed on the display 8 of the cursor movement controlling apparatus 100 according to the embodiment of the present invention.

FIG. 3 shows an example of a screen displayed on the display 8 of the cursor movement controlling apparatus 100 according to the embodiment of the present invention.

As shown in the drawing, the choices BOX corresponding to a plurality of parameters are displayed with being classified into either one of the groups GR1 to GR4. Further, the choice BOX of which color is inverted indicates that the corresponding function is turned on and therefore, it does not indicate the current cursor position.

Figure 4:
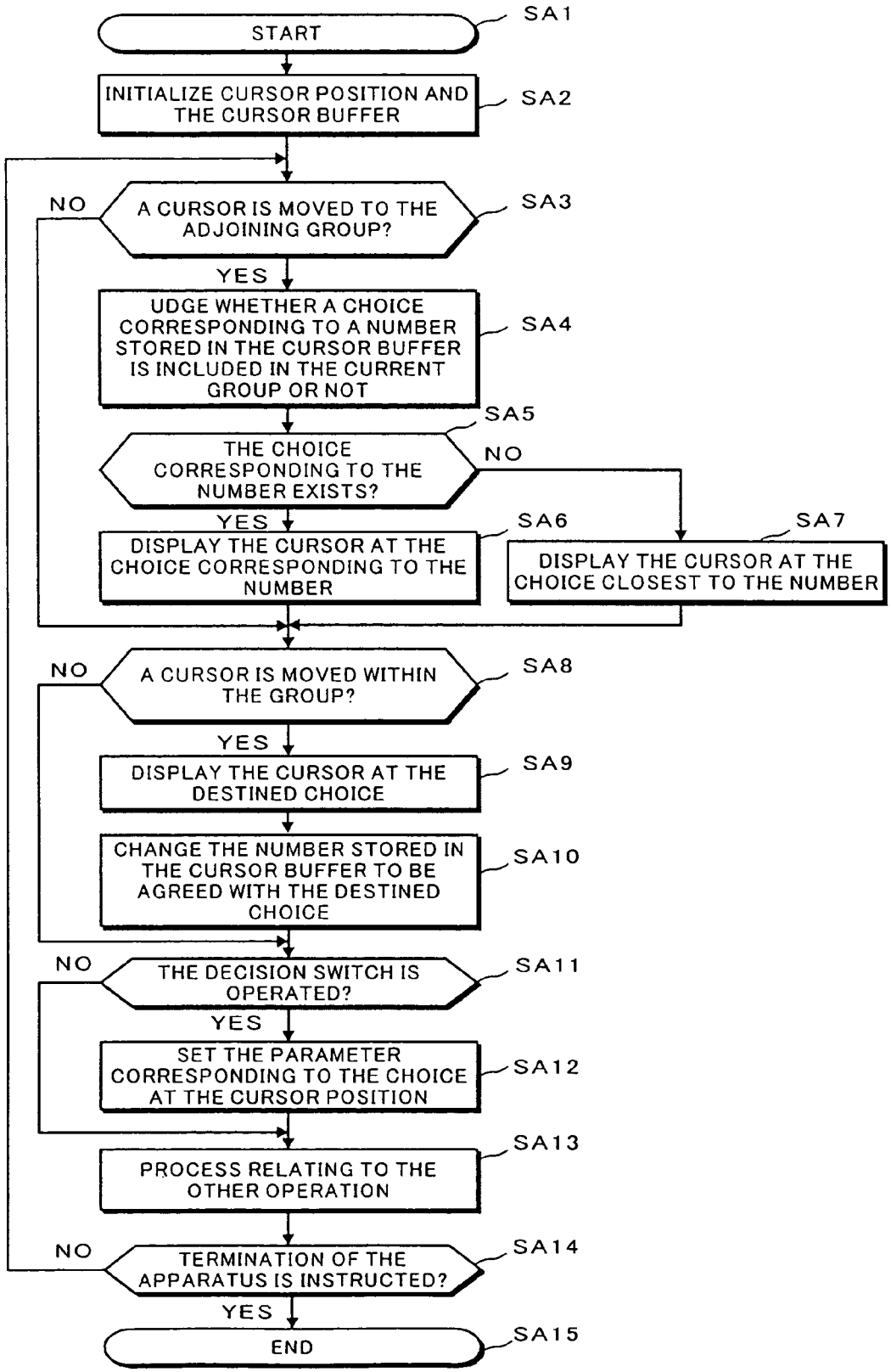
FIG. 4 is a flowchart showing a cursor movement controlling process for the cursor movement controlling apparatus 100 executed by a CPU 4 shown in FIG. 1.

FIG. 4 is a flowchart showing a cursor movement controlling process for the cursor movement controlling apparatus 100 executed by a CPU 4 shown in FIG. 1. This cursor movement controlling process is automatically started when a main power of the cursor movement controlling apparatus 100 is turned on.

At Step SA1, the cursor movement controlling process is started, and at Step SA2, initialization of the cursor position and the cursor buffer prepared in the RAM 3 (FIG. 1) is executed. In this initialization step, the cursor is controlled to be displayed at a predetermined choice (e.g., choice BOX10), and the cursor buffer value is set to be "0".

Further, the cursor buffer is a buffer memory for storing a number corresponding to information (the cursor buffer value) representing at which choice the cursor is displayed (to which choice the cursor is moved) when the cursor is moved from the adjoining group. For example, the cursor buffer is prepared in the RAM 3 shown in FIG. 1. The number (the cursor buffer value) stored in the cursor buffer corresponds to "0", "1", "2" . . . "n" from the top row to the bottom row where the plurality of the choices BOX are positioned in one group.

At Step SA3, it is detected whether the cursor is moved to the other adjoining group or not. When the cursor is moved to the other group, that is, when the cursor switch 6L (moving leftward) or 6R (moving rightward) shown in FIG. 2 is operated, the flow advances to Step SA4 as indicated by an arrow marked with "YES". When the cursor is not moved to the other group, that is, when the cursor is moved within the current group or the cursor is not moved at all, the flow advances to Step SA8 as indicated by an arrow marked with "NO".

At Step SA4, it is judged whether the choice BOX corresponding to the number stored in the cursor buffer exists in the group to which the cursor will be moved by the current operation or not with reference to the number (the cursor buffer value) stored in the cursor buffer. At Step SA5, it is judged whether the choice BOX corresponding to the number is judged to be existed at Step SA4 or not. When the choice is judged to exist, the flow advances to Step SA6 as indicated by an arrow marked with "YES". When the choice is judged not to exist, the flow advances to Step SA7 as indicated by an arrow marked with "NO".

At Step SA6, the cursor is moved to the choice BOX corresponding to the number (the cursor buffer value) in the group to which the cursor is instructed to be moved by the current operation (the adjoining group in the direction corresponding to the operation of the cursor switch detected at Step SA3), and the choice BOX where the cursor is moved is turned to be a selected condition by displaying the choice BOX with emphasis. Thereafter, the flow advances to Step SA8.

At Step SA7, it detects the choice BOX corresponding to a number closest to the number (the cursor buffer value) in the group to which the cursor is instructed to be moved by the current operation (the adjoining group in the direction corresponding to the operation of the cursor switch detected at Step SA3), and the cursor is moved to the detected choice BOX. The choice BOX where the cursor is moved is turned to be a selected condition by displaying the choice BOX with emphasis. Thereafter, the flow advances to Step SA8.

For example, when the number stored in the cursor buffer is "2" and the cursor is moved to the group in which only two choices BOX are included (e.g., when the cursor is moved from the group GR2 to the group GR1 in FIG. 2), the cursor is moved to the choice BOX corresponding to the number "1" (e.g., the choice BOX11 in FIG. 2).

Also, for example, when the number stored in the cursor buffer is "2" and the cursor is moved to the group in which only one choice BOX is included (e.g., when the cursor is moved from the group GR3 to the group GR4 in FIG. 2), the cursor is moved to the choice BOX corresponding to the number "0" (e.g., the choice BOX40 in FIG. 2).

At Step SA8, it is detected whether the cursor is moved with in the current group or not. When the cursor is moved within the group, that is, the cursor switch 6U (moving upward) or 6D (moving downward) shown in FIG. 2 is operated, the flow advances to Step SA9 as indicated by an arrow marked with "YES". When the cursor is not moved within the group, that is, the cursor is moved to the other group or the cursor is not moved at all, the flow advances to Step SA11 as indicated by an arrow marked with "NO".

At Step SA9, the cursor is moved to the adjoining choice BOX in the direction corresponding to the operation of the cursor switch detected at Step SA8, and the choice BOX where the cursor is moved is turned to be a selected condition by displaying the choice BOX with emphasis.

At Step SA10, the number (the cursor buffer value) in the cursor buffer prepared in the RAM 3 (FIG. 1) is overwritten with the number corresponding to the choice BOX to which the cursor is moved. At this step, for example, either one of following first example or second example of process is executed. The user can make selection of the process in advance.

In the first example of the process, the cursor buffer value is increased or decreased in accordance with the operation of the cursor switch detected at Step SA8. That is, when the cursor switch 6U (moving upward) is operated, the cursor buffer value is decreased by "1" (a new cursor buffer value=the old cursor buffer value−1). When the cursor switch 6D (moving downward) is operated, the cursor buffer value is increased by "1" (a new cursor buffer value=the old cursor buffer value+1).

In the second example of the process, the cursor buffer value is changed in accordance with the number corresponding to the choice BOX to which the cursor is moved at Step SA9. For example, when the number stored in the cursor buffer is "3" and the cursor is moved from the choice BOX22 from the choice BOX21 shown in FIG. 2, the cursor buffer value is changed to the number "1" corresponding to the choice BOX21.

At Step SA11, the operation of the decision switch 6E is detected. When the operation of the decision switch 6E is detected, the flow advances to Step SA12 as indicated by an arrow marked with "YES". When the operation of the decision switch 6E is not detected, the flow advances to Step SA13 as indicated by an arrow marked with "NO".

At Step SA12, a process corresponding to the choice BOX at the current cursor position is executed. The process executed at this step is, for example, switching of ON/OFF of a function, setting of the various parameters, the selection of the various data, execution of the various processes, changing to various modes, moving to other display pages or something like that.

At Step SA13, a process relating to other operation is executed. The process relating to other operation executed at this step is a process other than the movement of the cursor and the selection of the choice BOX, for example, a process for various mixing operations.

At Step SA14, it is detected whether termination of the process (power of the cursor movement controlling apparatus 100) is instructed or not. When the instruction is detected, the flow advances to Step SA15 as indicated by an arrow marked with "YES" and the cursor movement controlling process is finished. When the instruction is not detected, the flow returns to Step SA3 as indicated by an arrow marked with "NO".

Figure 5A:
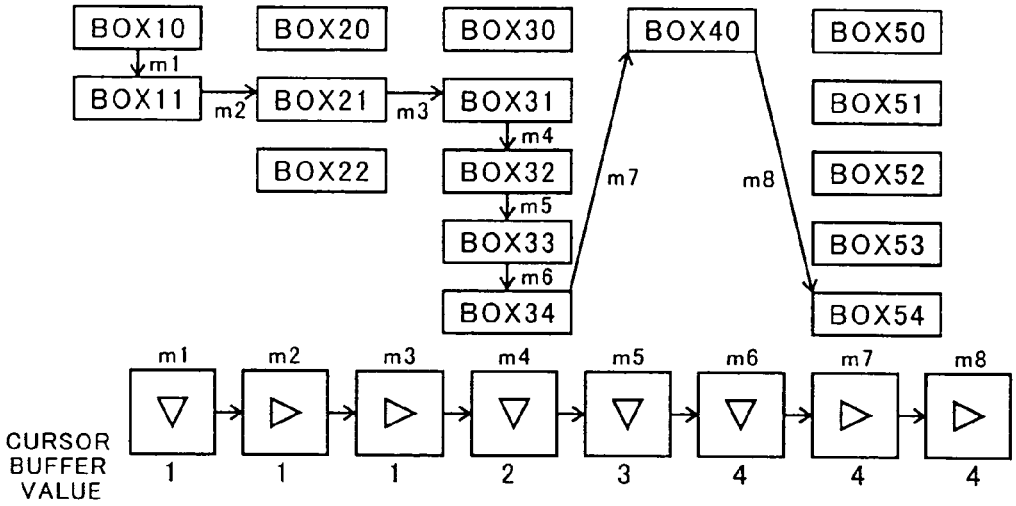
FIGS. 5A to 5C are diagrams showing examples of cursor movements according to the cursor movement controlling process shown in FIG. 4.
Figure 5B:
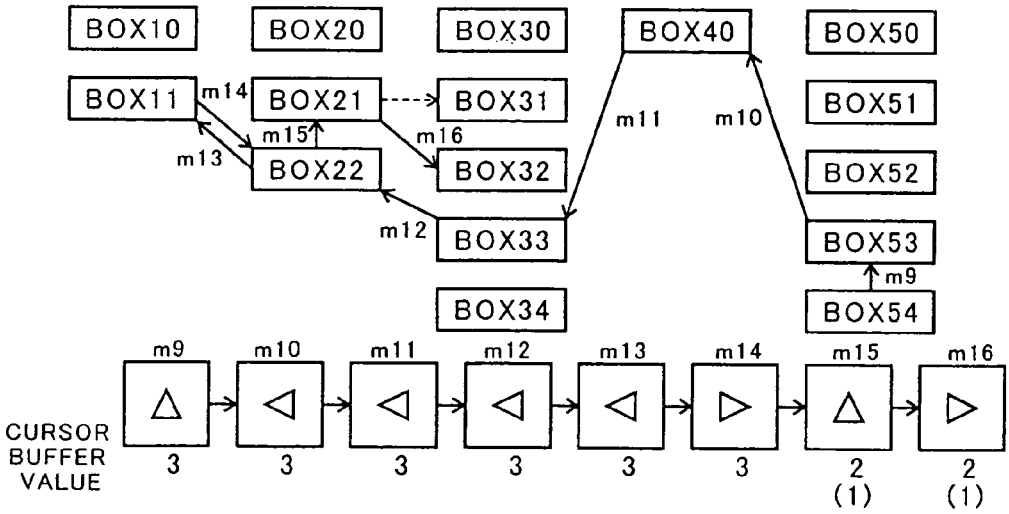
Figure 5C:
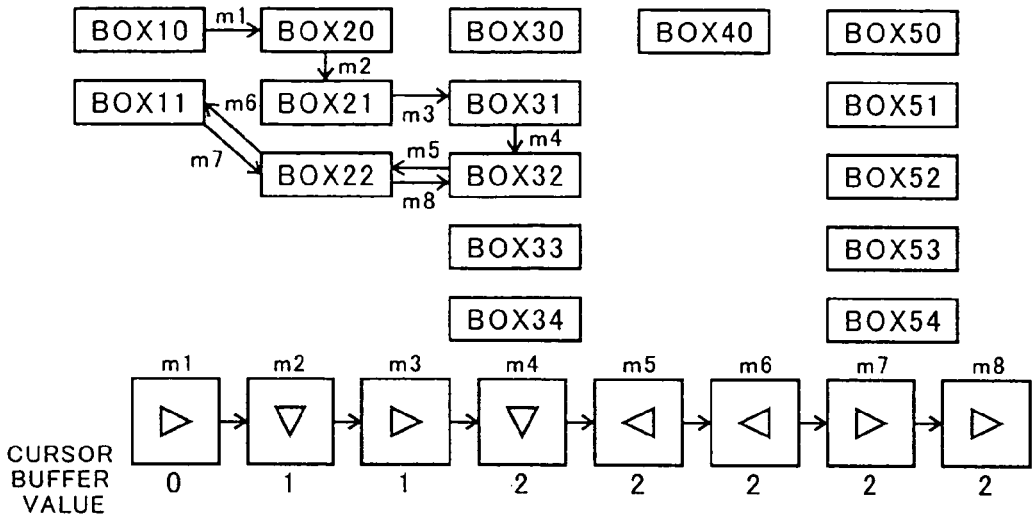

FIGS. 5A to 5C are diagrams showing examples of cursor movements according to the cursor movement controlling process shown in FIG. 4.

FIGS. 5A and 5B show an example of a consecutive cursor movement by the cursor movement controlling process shown in FIG. 4, and FIG. 5C shows other example.

First, the cursor operations m1 to m16 shown in FIG. 1A and FIG. 1B are explained. On the upper side of the drawing, the choices BOX are shown and the movements of the cursor positions by the operations m1 to m16 are depicted by arrows. On the lower side of the drawing, the cursor switches operated by the operations m1 to m16 are shown.

By the operation m1, the cursor is moved from the choice BOX10 to the choice BOX11. At this time, the number "1" is stored in the cursor buffer. By the operation m2, the cursor is moved from the choice BOX11 to the choice BOX 21 in the adjoining group GR2. In this case, the cursor buffer value is not changed because the cursor is not moved within the group. The operation m3 is similar to the operation m2.

By the operations m4 to m6, the cursor position is moved to the choice BOX34, and the number stored in the cursor buffer (the cursor buffer value) is changed to the number "4". Thereafter, the cursor is instructed to move to the group GR4 by the operation m7. The cursor is moved to the choice BOX40 corresponding to the number "0" that is the closet to the number "4" in the group GR4 because the group GR4 include only one choice BOX (BOX40), that is, there is no choice BOX corresponding to the number "4" in the group GR4. Next, by the operation m8, the cursor is moved to the group GR5. In this case, the cursor is moved to the choice BOX54 corresponding to the number "4" in the cursor buffer.

By the operation m9, the cursor is moved to the choice BOX53 in the same group, and the number store in the cursor buffer is changed to the number "3". Thereafter, the cursor is moved to the group GR4 by the operation m10. However, there is no choice BOX corresponding to the number "3" in the group GR3. Therefore, the cursor is moved to the choice BOX 40 corresponding to the number "0" that is the closet to the number "3" in the group GR4. Next, by the operation m11, the cursor is moved to the group GR3. In this case, the cursor is moved to the choice BOX33 corresponding to the number "3" in the cursor buffer.

By the next operation m12, the cursor is moved to the group GR2. In the group GR2, there is no choice BOX corresponding to the number "3"; therefore, the cursor is moved to the choice BOX 22 corresponding to the number "2" that is the closet to the number "3" in the group GR2. Also, by the next operation m13, the cursor is moved to the group GR1. In the group GR1, there is no choice BOX corresponding to the number "3"; therefore, the cursor is moved to the choice BOX11 corresponding to the number "1" that is the closet to the number "3" in the group GR1. The next operation m14 is similar to the operations m12 and m13.

During the above-described operations m9 to m14, the cursor buffer value is not changed; however, the number of the choices BOX in each group is different from each another. Therefore, the cursor is moved to the choices BOX in the different rows in groups.

By the next operation m15, the cursor is moved within the same group; therefore, the cursor buffer value is changed. The cursor movement after that will be different in accordance with the selection whether the above-described first example of the process at Step SA10 in FIG. 4 is executed or the above-described second example of the process at Step SA10 in FIG. 4 is executed.

When the first example of the process is selected and executed, the cursor buffer value is decreased by "1" in accordance with the upward movement of the cursor. Therefore, the cursor buffer value is changed to the number "2" by the operation m15. Thereafter, by the rightward movement by the operation m16, the cursor is moved to the choice BOX32 in the group GR3 with reference to the cursor buffer value "2".

When the second example of the process is selected and executed, the cursor buffer value is changed to the number "1" corresponding to the choice BOX21 where the cursor is moved. Therefore, by the operation m16 after that, as represented by the broken line arrow, the cursor is moved to the choice BOX31 corresponding to the number "1" in the group GR3.

Second, the cursor operations m1 to m8 shown in FIG. 1C are explained. On the upper side of the drawing, the choices BOX are shown and the movements of the cursor positions by the operations m1 to m8 are depicted by arrows. On the lower side of the drawing, the cursor switches operated by the operations m1 to m8 are shown.

By the operation m1, the cursor is moved from the choice BOX10 to the choice BOX20 in the adjoining group GR2. In this case, the cursor buffer value is not changed because the cursor is not moved within the group (the cursor is moved over the groups).

By the operation m2, the cursor is moved from the choice BOX20 to the choice BOX21. In this case, the cursor buffer number is changed to the number "1" because the cursor is moved within the same group.

By the operation m3, the cursor is moved from the choice BOX21 to the choice BOX31 in the adjoining group GR3. In this case, the cursor buffer value is not changed because the cursor is not moved within the group (the cursor is moved over the groups).

By the operation m4, the cursor is moved from the choice BOX31 to the choice BOX32. In this case, the cursor buffer number is changed to the number "2" because the cursor is moved within the same group GR3. By the operation m5, the cursor is moved to the group GR2. At this time, the cursor is moved to the choice BOX22 corresponding to the cursor buffer value "2".

Thereafter, the cursor is moved to the group GR1 by the operation m6. In the group GR1, there is no choice BOX corresponding to the number "2"; therefore, the cursor is moved to the choice BOX 11 corresponding to the number "1" that is the closet to the number "2" in the group GR1.

Next, by the operation m7, the cursor is returned to the previous group GR2. At this time, because the cursor buffer value "2" is referred, the cursor can be returned to the choice BOX22. Further, by the next operation m8, the cursor can be returned to the choice BOX32 with reference to the cursor buffer value "2".

As described above, according to the embodiment of the present invention, by equipping the cursor buffer for storing the cursor position, the cursor can be moved to the choice BOX in the same row of the other adjoining group when the cursor is moved over the groups. Moreover, when the numbers of the choices BOX included in the groups are different, the cursor can be moved to the choice BOX corresponding to the number (row) that is the closest to the number (row) of the original choice BOX.

Therefore, when the cursor is moved over the different groups, the cursor does not necessarily return to the top row of the group. Therefore, when the user mistakenly moves the cursor to the adjoining group, the user can easily (by only one operation) return the cursor to the original choice BOX in the original group GR.

Moreover, when the choices BOX in different groups GR having a general tendency to be chosen in a series are arranged in the same row, the desired choice BOX can be chosen only with the cursor switch of horizontal movement.

Further, in the above-described embodiment, the cursor buffer value is changed only by the vertical movements of the cursor but not changed by the horizontal movements of the cursor. Therefore, the cursor buffer value is not change by the cursor movement over the groups when the numbers of the choices BOX included in the groups GR are different from each another.

Although in the above-described embodiment, the only one cursor buffer shared by the all groups GR is prepared, a plurality of the cursor buffers respectively corresponding to all the groups GR may be prepared in the RAM 3.

Figure 6:
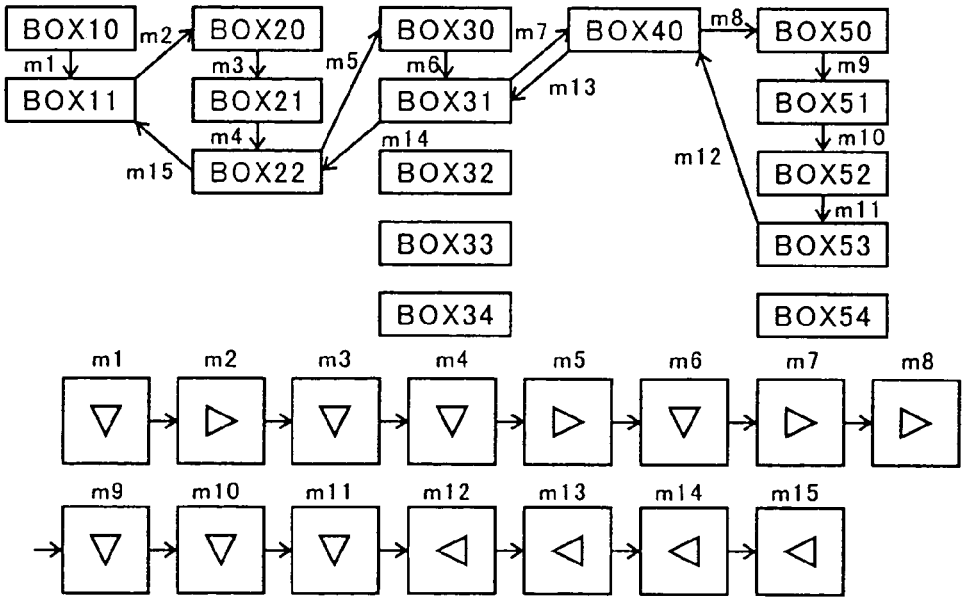
FIG. 6 is a diagram showing an example of a cursor movement according to a modified example of the embodiment of the present invention.

FIG. 6 is a diagram showing an example of a cursor movement according to a modified example of the embodiment of the present invention. In this modified example, the cursor buffer is prepared for each group GR, and the previous cursor position within each group is stored. In this case, the cursor is moved to the previous cursor position with reference to the cursor buffer corresponding to the group to which the cursor will be moved.

This modified example can be executed by changing the cursor buffer values individually group by group at Step SA10 of the cursor movement controlling process shown in FIG. 4.

On the upper side of the drawing, the choices BOX are shown and the movements of the cursor positions by the operations m1 to m15 are depicted by arrows. On the lower side of the drawing, the cursor switches operated by the operations m1 to m15 are shown.

By the operation m1, the cursor is moved from the choice BOX10 to the choice BOX11. At the mean time, the number "1" is stored in the cursor buffer corresponding to the group GR1. By the operation m2, the cursor is moved from the choice BOX11 to the choice BOX20 in the adjoining group. In this case, the cursor is moved to the top row of the group GR2 because each group GR uses the different cursor buffer and the number in the cursor buffer corresponding to the group GR2 is "0".

By the operations m3 and m4, the cursor is moved to the choice BOX22, and the number stored in the cursor buffer corresponding to the group GR2 becomes "2". Thereafter, by the operation m5, the cursor is moved to the choice BOX30 in the top row of the adjoining group GR3 similar to the operation m2. The operations m6 and m7 are similar to the operations m4 and m5. By the operation m8, the cursor is horizontally moved from the choice BOX 40 to the choice BOX50.

By the operations m9 to m11, the cursor is moved to the choice BOX53, and the number stored in the cursor buffer corresponding to the group GR5 becomes "3". Thereafter, by the operation m12, the cursor is returned to the choice BOX40.

By the operation m13, the cursor is moved to the choice BOX31 corresponding to the number "1" stored by the operation m6 of the cursor buffer corresponding to the group GR3 although only the horizontal movement cursor switch is operated.

Thereafter, by the operation m14, the cursor is moved to the choice BOX22 corresponding to the number "2" stored by the operation m4 of the cursor buffer corresponding to the group GR2 although only the horizontal movement cursor switch is operated.

Similarly, by the operation m15, the cursor is moved to the choice BOX11 corresponding to the number "1" stored by the operation m1 of the cursor buffer corresponding to the group GR1 although only the horizontal movement cursor switch is operated.

As described above, according to the modified example of the embodiment, the independent cursor buffer for each group GR is prepared, and so the information of the choice BOX where the cursor past last time can be stored for each group. Therefore, the cursor can be easily returned to the last position within the group.

As described above, according to the modified example of the embodiment, by preparing the cursor buffer for storing the cursor position, the cursor can be easily returned to the previously selected (set) parameters with a small number of the operations. Therefore, settings of functions and parameters can be quickly changed in an electronic musical apparatus that needs a real time operation, such as a mixing device and a musical keyboard.

Although, in the above-described embodiment and the modified example, the plurality of the groups GR are displayed being aligned horizontally, display styles of the groups GR and the choices BOX are not limited to that style and any styles wherein the plurality of the groups GR, each including different number of the choices BOX are displayed and the cursor is moved within and over the groups can be used. For example, the groups GR may be aligned vertically. In that case, the cursor buffer stores the horizontal movement information, and the cursor position is decided with reference to the cursor buffer when the cursor is moved vertically.

The present invention is not limited only to the above embodiments. It is apparent that various modifications, improvements, combinations, and the like can be made by those skilled in the art. For example, the following modifications can be possible.

What is claimed is:

1. A cursor movement controlling apparatus for an electronic musical apparatus, comprising:

a display that displays a plurality of choices for controlling parameters of the electronic music apparatus, each choice categorized into one of a plurality of groups and corresponding to a value, and only one cursor for selecting a choice from the plurality of displayed choices, said plurality of groups displayed simultaneously on one screen, said plurality of choices displayed for each of the plurality of groups, said cursor capable of moving in an up/down direction and in a right/left direction wherein one direction is for moving among the plurality of groups and the other direction is for moving among the plurality of choices in the same group;

an instructor that instructs a movement of the displayed cursor from a current choice at which the cursor is currently displayed to another choice;

a movement storage device that stores choice information corresponding to a value shared by all of the plurality of groups, the choice information indicating at which choice in a group the cursor should be displayed when the cursor is moved to the group from one of the choices in another group; and a cursor moving device that moves, when the movement of the cursor from a current choice in a first group to another choice in the same group is instructed, the cursor to the another choice and stores the movement of the cursor as the choice information in the movement storage device, and that moves, when the movement of the cursor from a current choice in said first group to a choice in a second group is instructed, the cursor to a choice in said second group indicated by the choice information wherein, if the choice corresponding to the choice information does not exist in the second group, the cursor moving device moves the cursor to a choice in said second group corresponding to a value numerically closest to the value of the choice information.

2. A cursor movement controlling apparatus for an electronic musical apparatus according to claim 1, wherein the movement storage device stores information concerning a direction and a distance of the movement of the cursor within the first group as choice information.

3. A cursor movement controlling apparatus for an electronic musical apparatus according to claim 1, wherein the movement storage device stores information concerning a position of the cursor within the first group as choice information.

4. A cursor movement controlling apparatus for an electronic musical apparatus according to claim 1, wherein the cursor moving device moves the cursor in accordance with the instruction of the instructor when the movement of the cursor within the first group is instructed.

5. A cursor movement controlling method for an electronic musical apparatus, comprising the steps of:

displaying a plurality of choices for controlling parameters of the electronic music apparatus, each choice categorized into one of a plurality of groups and corresponding to a value, and only one cursor for selecting a choice from the plurality of displayed choices, wherein said plurality of groups are displayed simultaneously, on one screen, said plurality of choices are displayed for each of the plurality of groups and said cursor is capable of moving in an up/down direction and in a right/left direction wherein one direction is for moving among the plurality of groups and the other direction is for moving among the plurality of choices in the same group;

instructing a movement of the displayed cursor from a current choice at which the cursor is currently displayed to another choice;

storing choice information corresponding to a value shared by all of the plurality of groups, the choice information indicating at which choice in a group the cursor should be displayed when the cursor is moved to the group from one of the choices in another group; and moving, when the movement of the cursor from a current choice in a first group to another choice in the same group is instructed, the cursor to the another choice and storing the movement of the cursor as the choice information in the movement storage device, and moving, when the movement of the cursor from a current choice in said firsi group to a choice in a second group is instructed, the cursor to a choice in said second group indicated by the choice information wherein, if the choice corresponding to the choice information does not exist in the second group, moving the cursor to a choice in said second group corresponding to a value numerically closest to the value of the choice information.

6. A computer-readable medium for storing a cursor movement controlling program, for causing an electronic musical apparatus to execute a method, said method comprising the steps of:

displaying a plurality of choices for controlling parameters of the electronic music apparatus, each choice categorized into one of a plurality of groups and corresponding to a value, and only one cursor for selecting a choice from the plurality of displayed choices, wherein said plurality of groups are displayed simultaneously on one screen, said plurality of choices are displayed for each of the plurality of groups and said cursor is capable of moving in an up/down direction and in a right/left direction wherein one direction is for moving among the plurality of groups and the other direction is for moving among the plurality of choices in thesame group;

instructing a movement of the displayed cursor from a current choice at which the cursor is currently displayed to another choice;

storing choice information corresponding to a value shared by all of the plurality of groups, the choice information indicating at which choice in a group the cursor should be displayed when the cursor is moved to the group from one of the choices in another group; and moving, when the movement of the cursor from a current choice in a first group to another choice in the same group is instructed, the cursor to the another choice and.storing themovement of the cursor as the choice information in the movement storage device, and moving, when the movement of the cursor from a current choice in said first group to a choice in a second group is instructed, the cursor to a choice in said second group indicated by the choice information wherein, if the choice corresponding to the choice information does not exist in the second group, the cursor moving device moves the cursor to a choice in said second group corresponding to a value numerically closest to the value of the choice information.

* * * * *